US007755221B2

(12) United States Patent
Liu et al.

(10) Patent No.: US 7,755,221 B2
(45) Date of Patent: Jul. 13, 2010

(54) ELECTRONIC DEVICE WITH COMPOUND AUDIO INTERFACE AND POWER ADAPTER

(75) Inventors: Chang-Chun Liu, Shenzhen (CN); Xiao-Lin Gan, Shenzhen (CN); Yu-Kuang Ho, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 315 days.

(21) Appl. No.: 11/960,714

(22) Filed: Dec. 20, 2007

(65) Prior Publication Data

US 2009/0140578 A1 Jun. 4, 2009

(30) Foreign Application Priority Data

Nov. 29, 2007 (CN) ..... 2007 1 0202784

(51) Int. Cl.
*H01H 83/00* (2006.01)
*H01H 47/00* (2006.01)

(52) U.S. Cl. ..... 307/126; 307/119; 307/132 E; 307/154

(58) Field of Classification Search ..... 307/119, 307/126, 132 E, 132 EA, 132 M, 139, 143, 307/154

See application file for complete search history.

(56) References Cited

U.S. PATENT DOCUMENTS 4,653,087 A * 3/1987 Galich ..... 379/110.01
5,952,741 A * 9/1999 Toy ..... 307/326
6,552,512 B1 * 4/2003 Harris ..... 320/107
6,643,595 B2 * 11/2003 Rakshani et al. ..... 702/60
7,548,040 B2 * 6/2009 Lee et al. ..... 320/108

* cited by examiner

*Primary Examiner*—Albert W Paladini
*Assistant Examiner*—Hal I Kaplan
(74) *Attorney, Agent, or Firm*—Frank R. Niranjan

(57) ABSTRACT

An exemplary electronic device includes a power module having an anode and a cathode; an audio module having an audio signal terminal and a ground terminal; an audio socket having an audio signal terminal and a ground terminal; a first relay-switch; a second relay-switch; and a power adapter having an audio plug, wherein the audio terminal of the audio socket is selectively connected to the anode of the power module and the audio signal terminal of the audio module via the first relay-switch, the ground terminal of the audio socket is selectively connected to the cathode of the power module and the ground terminal of the audio module via the second relay-switch, the audio terminal and the ground terminal of the audio socket are connected to the anode and cathode of the power module when the audio plug is plugged into the audio socket.

2 Claims, 5 Drawing Sheets

ELECTRONIC DEVICE WITH COMPOUND AUDIO INTERFACE AND POWER ADAPTER

CROSS-REFERENCES TO RELATED APPLICATION

Relevant subject matter is disclosed in a co-pending U.S. patent application Ser. No. 11/960,712 filed on the same date and having a same title, which is assigned to the same assignee as this patent application.

BACKGROUND

1. Field of the Invention

The present invention relates to electronic devices, and particularly to an electronic device with a compound audio interface and a power adapter.

2. Description of Related Art

Conventionally, many different interfaces are arranged in an electronic device such as MP3, MP4, mobile telephone and so on, for example USB interface, audio interface, charger interface and so on. These interfaces are arranged in the electronic device for different purposes and each has a special standard.

Referring to FIG. 4, a conventional electronic device includes an audio socket 10, a power socket 12, an audio module 14, and a power module 16. The audio module 14 is connected to the audio socket 10 for transmitting audio signals. The power module 16 is connected to the power socket 12 for connecting with a charger.

Referring to FIG. 5, a conventional power adapter includes an adapter module 18 arranged to connect to a power source, and a power plug 22 arranged to plug into the power socket 12 of the electronic device for charging the device.

SUMMARY

An exemplary electronic device includes a power module having an anode and a cathode; an audio module having a first audio signal terminal, a second audio signal terminal and a ground terminal; an audio socket having a first audio signal terminal, a second audio signal terminal connected to the second audio terminal of the audio module, and a ground terminal; a first relay-switch; a second relay-switch; and a power adapter comprising: an adapter module having an anode and a cathode; and an audio plug arranged to plug into the audio socket, the audio plug having an audio signal terminal and a ground terminal connected to the anode and the cathode of the adapter respectively, wherein the first audio terminal of the audio socket is selectively connected to the anode of the power module and the first audio signal terminal of the audio module via the first relay-switch, the ground terminal of the audio socket is selectively connected to the cathode of the power module and the ground terminal of the audio module via the second relay-switch, the first audio terminal and the ground terminal of the audio socket are connected to the anode and cathode of the power module when the audio plug is plugged into the audio socket.

Other advantages and novel features of the present invention will become more apparent from the following detailed description of preferred embodiment when taken in conjunction with the accompanying drawings, in which:

DETAILED DESCRIPTION

Figure 1:
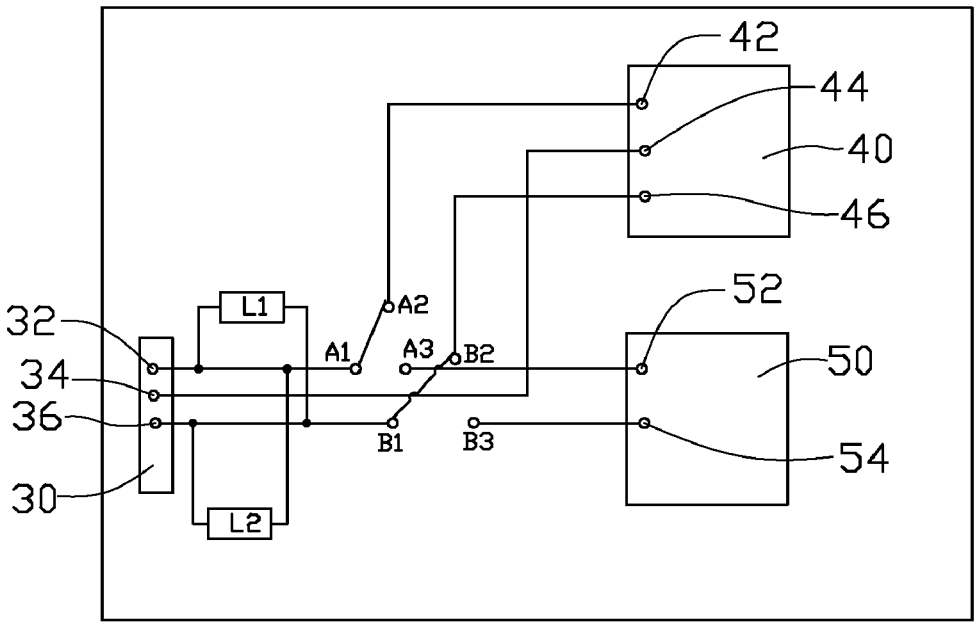
FIG. 1 is a schematic diagram of an electronic device with a compound audio interface in accordance with an embodiment of the present invention.

Referring to FIG. 1, an electronic device in accordance with an embodiment of the present invention includes an audio socket 30, an audio module 40, and a power module 50, a first relay-switch, and a second relay-switch. The audio socket 30 includes a first audio signal terminal 32, a second audio signal terminal 34, and a ground terminal 36. The audio module 40 includes two audio signal terminals 42 and 44, and a ground terminal 46. The power module 50 includes an anode 52 and a cathode 54. The first relay-switch includes a pole A1, two throws A2 and A3, and a relay L1. The second relay-switch includes a pole B1, two throws B2 and B3, and a relay L2.

The first audio signal terminal 32 of the audio socket 30 is connected to the pole A1 of the first relay-switch, the throws A2 and A3 are connected to the audio signal terminal 42 of the audio module 40 and the anode 52 of the power module 50 respectively. The second audio signal terminal 34 of the audio socket 30 is connected to the audio signal terminal 44 of the audio module 40. The ground terminal 36 of the audio socket 30 is connected to the pole B1 of the second relay-switch, the throws B2 and B3 are connected to the ground terminal 46 of the audio module 40 and the cathode 54 of the power module 50 respectively. The relays L1 and L2 are connected between the first audio signal terminal 32 of the audio socket 30 and the ground terminal 36 of the audio socket 30. The poles A1 and B1 are connected to the throws A2 and B2 respectively at an initial state, and are connected to the throws A3 and B3 when a current passes through the relays L1 and L2.

Figure 2:
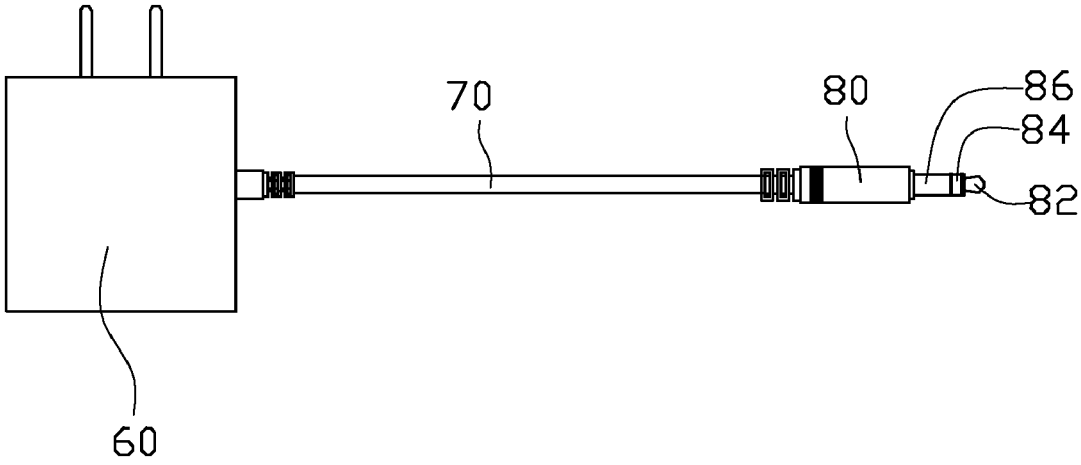
FIG. 2 is a schematic diagram of a power adapter of the electronic device of FIG. 1.
Figure 3:
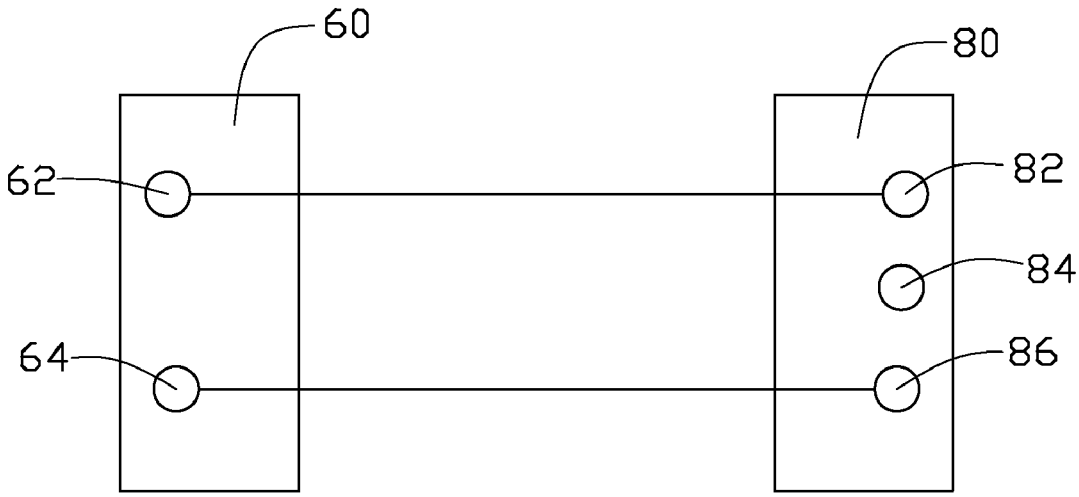
FIG. 3 is a circuit diagram of FIG. 2.
Figure 4:
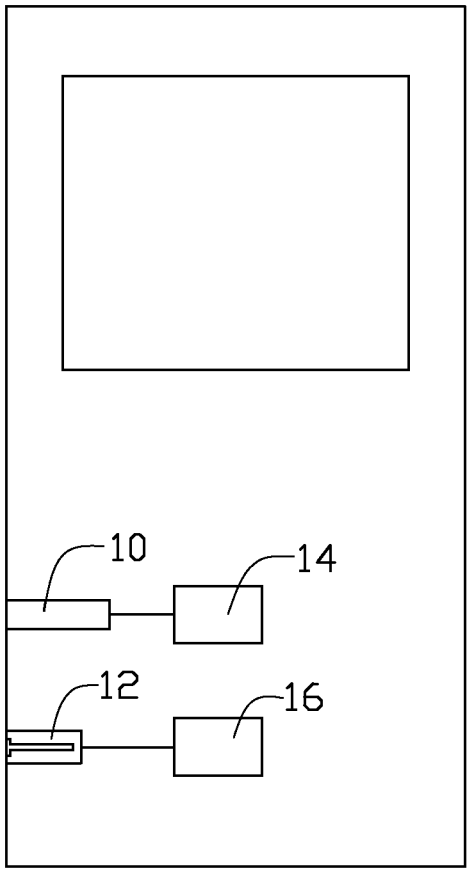
FIG. 4 (RELATED ART)
FIG. 4 is a schematic diagram of a conventional electronic device.
Figure 5:
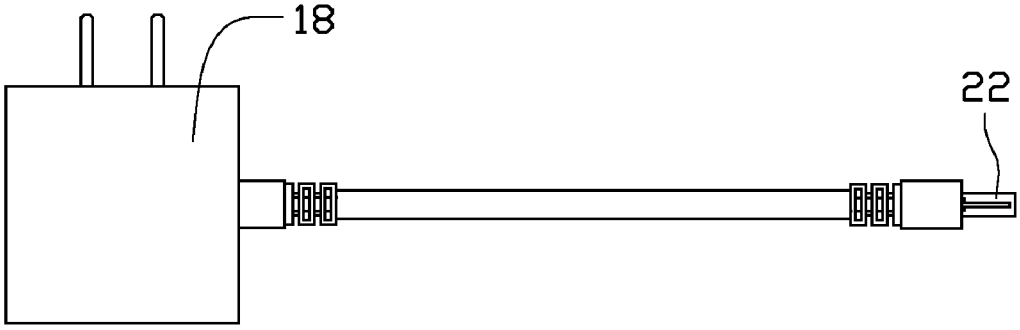
FIG. 5 (RELATED ART)
FIG. 5 is a schematic diagram of a conventional power adapter.

Referring to FIG. 2 and FIG. 3, a power adapter includes an adapter module 60, a cable 70, and an audio plug 80. The adapter module 60 includes an anode 62 and a cathode 64. The audio plug 80 includes a first audio signal terminal 82, a second audio signal terminal 84, and a ground terminal 86, wherein the first audio signal terminal 82 and the ground terminal 86 are connected to the anode 62 and the cathode 64 of the adapter module 60 via the cable 70. Therefore, when the audio plug 80 is plugged into the audio socket 30 of the electronic device, the audio socket 30 is coupled with the power module 50 of the electronic device via the first and the second relay-switches for charging the electronic device by the power adapter.

The audio socket 30 of the electronic device is automatically connected to the power module 50 of the electronic device when the audio plug 80 of the power adapter is plugged into the audio socket 30 for charging the electronic device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic device comprising:

a power module having an anode and a cathode;

an audio module having a first audio signal terminal, a second audio signal terminal and a ground terminal;

an audio socket having a first audio signal terminal, a second audio signal terminal connected to the second audio signal terminal of the audio module, and a ground terminal;

a first relay-switch;

a second relay-switch; and a power adapter comprising:

an adapter module having an anode and a cathode; and an audio plug arranged to plug into the audio socket, the audio plug having an audio signal terminal and a ground terminal connected to the anode and the cathode of the adapter module respectively, wherein the first audio terminal of the audio socket is selectively connected to the anode of the power module and the first audio signal terminal of the audio module via the first relay-switch, the ground terminal of the audio socket is selectively connected to the cathode of the power module and the ground terminal of the audio module via the second relay-switch, and the first audio terminal and the ground terminal of the audio socket are connected to the anode and cathode of the power module when the audio plug is plugged into the audio socket.

2. The electronic device as claimed in claim 1, wherein the relays of the first and second relay-switches are connected between the first audio signal terminal and the ground terminal of the audio socket.

* * * * *